US008448387B2

(12) United States Patent
Hartmann

(10) Patent No.: US 8,448,387 B2
(45) Date of Patent: May 28, 2013

(54) WALL PANEL AND METHOD

(75) Inventor: Frederick Hartmann, Chicago, IL (US)

(73) Assignee: Integrity Wall, LLC, Chicago, IL (US)

( * ) Notice: Subject to any disclaimer, the term of this patent is extended or adjusted under 35 U.S.C. 154(b) by 195 days.

(21) Appl. No.: 12/868,474

(22) Filed: Aug. 25, 2010

(65) Prior Publication Data

US 2011/0047910 A1 Mar. 3, 2011

Related U.S. Application Data

(60) Provisional application No. 61/238,897, filed on Sep. 1, 2009.

(51) Int. Cl.
*E04H 9/00* (2006.01)
*E04G 21/00* (2006.01)
*E04H 9/14* (2006.01)

(52) U.S. Cl.
USPC ..... 52/79.1; 52/127.2; 52/745.09; 264/34

(58) Field of Classification Search
USPC ..... 52/127.2, 742.14, 745.09; 264/31, 264/34
See application file for complete search history.

(56) References Cited

U.S. PATENT DOCUMENTS 1,031,926 A * 7/1912 Hansbrough ..... 52/259
1,850,118 A * 3/1932 Meyers ..... 52/223.6
1,986,172 A * 1/1935 Wilson ..... 52/520
2,104,870 A * 1/1938 Levy ..... 52/264
3,959,940 A * 6/1976 Ramberg ..... 52/348
4,200,946 A * 5/1980 Lawrence ..... 14/4
4,250,675 A * 2/1981 Meckler ..... 174/481
4,267,682 A * 5/1981 Fowler et al. ..... 52/657
4,349,996 A * 9/1982 Lautensleger et al. ..... 52/650.2
4,494,353 A * 1/1985 Lewis ..... 52/745.19
4,545,159 A * 10/1985 Rizk ..... 52/79.9
4,918,897 A * 4/1990 Luedtke ..... 52/742.14
5,335,472 A * 8/1994 Phillips ..... 52/742.14
5,522,194 A * 6/1996 Graulich ..... 52/309.4
5,687,956 A * 11/1997 Vesper ..... 256/31
5,761,873 A * 6/1998 Slater ..... 52/693
6,314,696 B2 * 11/2001 Fust, III ..... 52/422
6,389,767 B1 * 5/2002 Lucey et al. ..... 52/295
6,725,601 B2 * 4/2004 Chick ..... 47/83
7,140,155 B1 * 11/2006 Nasimov ..... 52/236.8
7,665,257 B2 * 2/2010 Posey ..... 52/223.13
7,805,908 B2 * 10/2010 Rutledge ..... 52/742.14
2005/0193678 A1 * 9/2005 Rutledge ..... 52/600

* cited by examiner

*Primary Examiner* — Brian Glessner
*Assistant Examiner* — Joseph J Sadlon
(74) *Attorney, Agent, or Firm* — Leydig, Voit & Mayer, Ltd.

(57) ABSTRACT

The disclosure provides a system and method for constructing support structures in buildings or other projects, which can support molds for use when pouring reinforced concrete slabs. The disclosed structures can accommodate more than one molds stacked vertically one over the other, and can remain in place to define walls or other separators in the completed structure. In one embodiment, the disclosed structure is a wall panel including a frame and vertical support members. The wall panel includes features allowing the vertical stacking of multiple wall panels. A temporary bracing system is further disclosed for use when stabilizing multiple stacked panels until construction of the surrounding floor or ceiling slabs has been completed.

15 Claims, 4 Drawing Sheets

WALL PANEL AND METHOD

CROSS-REFERENCE TO RELATED APPLICATIONS

This patent application claims the benefit of U.S. Provisional Patent Application No. 61/238,897, filed Sep. 1, 2009, which is incorporated herein in its entirety by reference.

FIELD OF THE INVENTION

The invention relates to modular wall panels for use in construction of high rise structures, including but not limited to floor support wall panels for use during and after pouring of reinforced concrete floor slabs.

BACKGROUND OF THE INVENTION

When constructing high-rise buildings that include more than one floors, typical construction methods include creating a temporary support structure on a newly formed floor surface. This support structure is used to support molds that will form the next floor slab. Thus, the construction of multi-floor buildings requires the sequential pouring of floors, which also involves the erection and removal of support structures and/or scaffolding on successive floors.

Typical support structures include scaffolding constructed by tubing having a round cross section. Such scaffolding is erected on the floor slab of a newly poured floor to support molds that will be used to poor the floor above. The scaffolding may be dismantled when pouring of a floor above is complete, and moved for re-erection when successively pouring other floors.

The successive re-use of scaffolding in erecting, dismantling, and re-erecting the structure for each floor of a multi-story building can be quite labor intensive and time consuming. Moreover, additional wall structures are required for newly formed floors after the pouring of the "floor" and "ceiling" slabs are complete.

BRIEF SUMMARY OF THE INVENTION

The structures and methods provided in the present disclosure are advantageously adapted for reducing the labor and time required to pour successive floor slabs when constructing a multi-story structure. In a general aspect, the disclosure provides wall panels that can be erected for more than floors simultaneously when constructing a multi-story building. The erected wall panels can support more than one floor molds at the same time, thus allowing for the simultaneous pouring of more than one floors. Moreover, in one embodiment, the disclosed wall panels may be permanently erected in place to provide vertical and shear support to the building after the floor slabs have been poured. The disclosed wall structures are configured to provide useable structural support to a building, as well as useable surfaces for forming walls after completion of construction. These and other aspects for the disclosure will become apparent from the following discussion read in conjunction with the illustrations of the several views of the drawings.

DETAILED DESCRIPTION OF THE INVENTION

Figure 1:
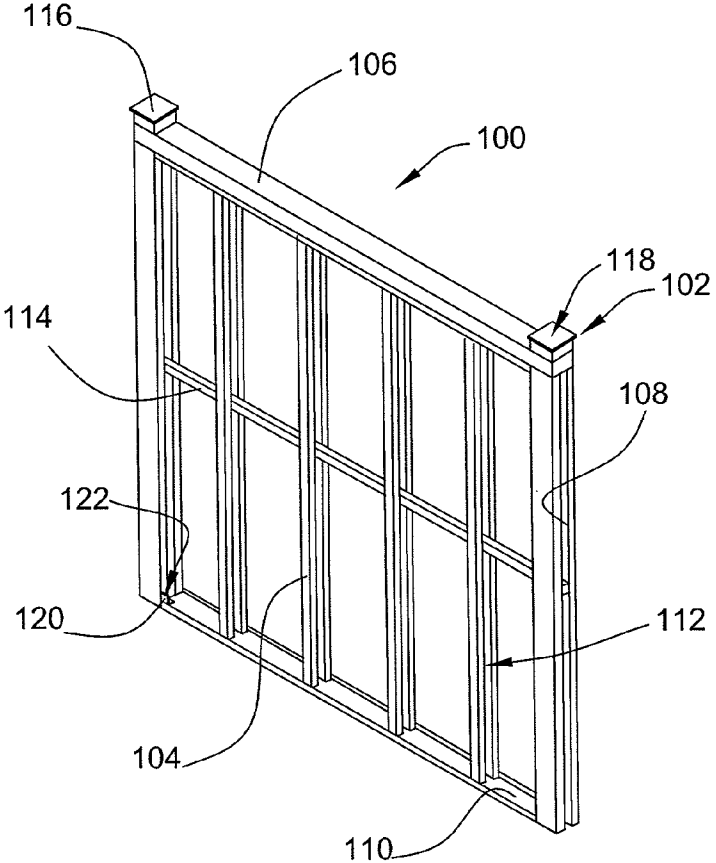
FIG. 1 is an outline view of a wall panel in accordance with the disclosure.

FIG. 1 is an outline view of a wall panel 100 in accordance with the disclosure. The wall panel 100 essentially operates as a load bearing structure for supporting vertical loading. The wall panel 100 can be constructed at any desired length and, in one embodiment, can be used as a unitary structure to support a similar wall panel disposed above the wall panel 100 along the entire length or width of a floor slab of a building. In an alternate embodiment, the wall panel 100 may have a predetermined, modular length, for example, 2-32 ft. (0.61-9.75 m). In that embodiment, two or more modular wall panels may be connected, for example, by bolted or welded connections, to form a wall panel of a desired length.

The wall panel 100 includes an outer or box frame 102 having internal supports 104 extending vertically along its length. The box frame 102 operates to support vertical loading and includes a top rail 106, two side rails 108, and a bottom rail 110. The top rail 106, side rails 108, and internal supports 104 are made of rectangular tube stock, the dimensions of which may be adjusted to provide adequate support for the loading expected to be applied onto the wall panel 100. The top rail 106 operates to distribute the load applied to the wall panel 100 evenly along its length and is formed by a single rectangular tube having a width that is equal to the overall width of the wall panel 100.

The bottom rail 110 is made of a cold-formed steel sheet shaped in a U-section channel. The side rails 108 and internal supports 104 can be made of the same tubular stock, as shown in FIG. 1, but may alternatively be made of tubular or other stock having different dimensions. The side rails 108 are arranged in pairs with each member of the pair disposed along the outer edges of the wall panel 100. In the illustrated embodiment, the side rails 108 and vertical supports 104 are made of square 2×2 in. (about 5×5 cm.) tubing of 3/16 in. (0.48 cm.) gage steel. The steel used for constructing the panels can be galvanized, and may additionally be treated after installation with corrosion and/or heat protective coatings. The side rails 108 and internal supports 104 are welded along the outside edges of the top rail 106 and to the inside edges of the bottom rail 110 on the bottom. A gap 112 is defined between each pair of side rails 108 and vertical supports 104, which can provide a passageway for conduits or pipes in a completed internal wall. The width of the wall 100 and the dimensions of the side rails 108 and vertical supports 104 determines the width of the gap 112.

The wall panel 100 further includes a horizontal bridging rail 114 extending horizontally along the length of the wall panel 100 and disposed at about the midsection thereof. The horizontal bridging rail 114 in the illustrated embodiment is disposed within the gap 112 and is connected to the side rails 108 and vertical supports 104 to provide stability to the wall panel.

During use, two or more wall panels 110 may be stacked one on top of the other to build a multi-story structure that can support molds or other floor/ceiling slab structures. Vertical interconnection between adjacent wall panels 100 can be accomplished by a bolted or welded connection arrangement. In the illustrated embodiment, a block 116 having a hole 118 is disposed on either end of the wall panel 100 atop the ends of the top bar 106. Each block 116 may be made of a section of square or rectangular tube stock, and the hole 118 may be formed through the top side wall of each block 118 to accommodate a bolt therethrough (not shown) for connecting an additional panel 110. In a similar arrangement, two angled brackets 120 may be disposed, one each, at each end of the wall panel 110 along an inner horizontal surface of the bottom rail 110 to provide structural reinforcement around a hole 122. Each hole 122 extends through components of the wall panel 110 to provide an opening for attaching the wall panel 100 onto another panel disposed beneath it (not shown) as is described below relative to the illustrations of FIGS. 3-5.

Figure 2:
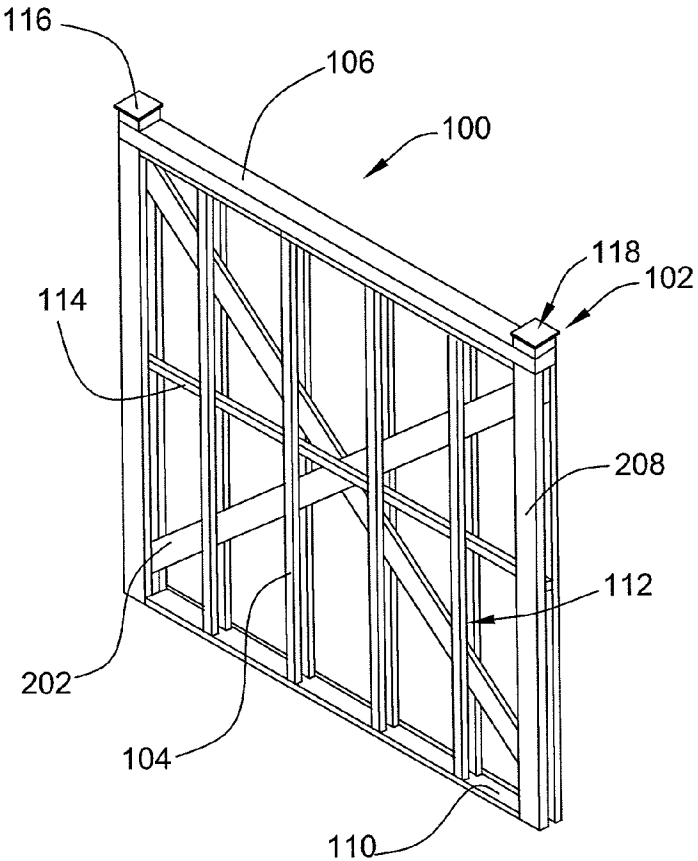
FIG. 2 is an outline view of an alternate embodiment of a wall panel in accordance with the disclosure.

Before describing the interconnections of wall panels, a variation of the wall panel 100 is shown in FIG. 2, where elements that are the same or similar to elements already described relative to the wall panel 100 (shown in FIG. 1) are denoted by the same reference numerals previously used. The wall panel 200 shown in FIG. 2 is specifically arranged to provide improved resistance to shear stresses, which makes the wall panel 200 suitable for use when constructing the core portion of a building or for surfaces of a building exposed to wind or seismic loading.

Similar to the wall panel 100, the wall panel 200 includes top and bottom rails 106 and 110. The side rails 208 are made of a stock having an increased outer profile, which provides improved resistance to shear loading. In addition, the wall panel 200 includes two cross braces 202, which extend in an "X" configuration between the four corners of the outer frame 102. Similar to the horizontal bridging rail 114, the cross braces 202 are made of rectangular tube stock and extend within the gap 112 defined between the pairs of side rails 208 and the vertical supports 104. At their ends, the two cross braces 202 may be bolted, pinned, or welded to the side rails 208. Because of the cross braces 202, the wall panel 200 may be made into modular lengths, for example, in 8 ft. (2.44 m.) lengths, that can be connected by use of bolted or welded connections.

Figure 3:
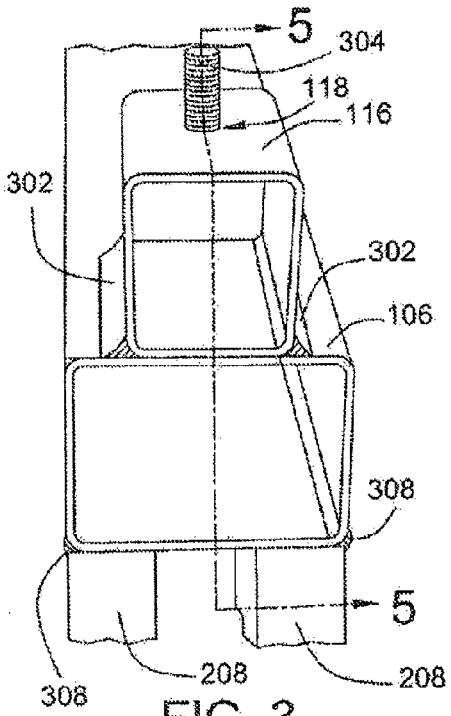
FIG. 3 is a partial view of the top portion of a connector for a wall panel in accordance with the disclosure.
Figure 4:
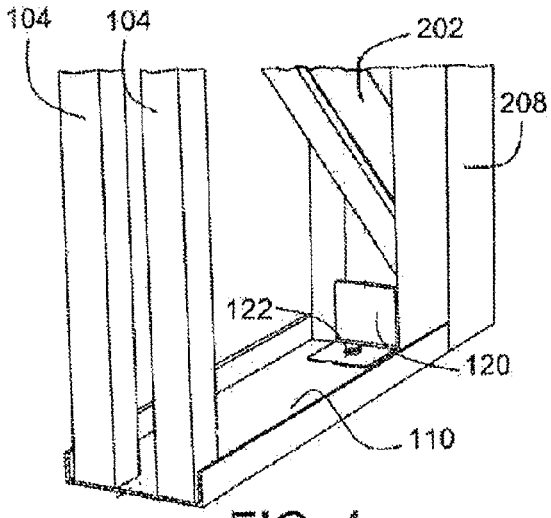
FIG. 4 is a partial view of a bottom portion of a connector for a wall panel in accordance with the disclosure.
Figure 5:
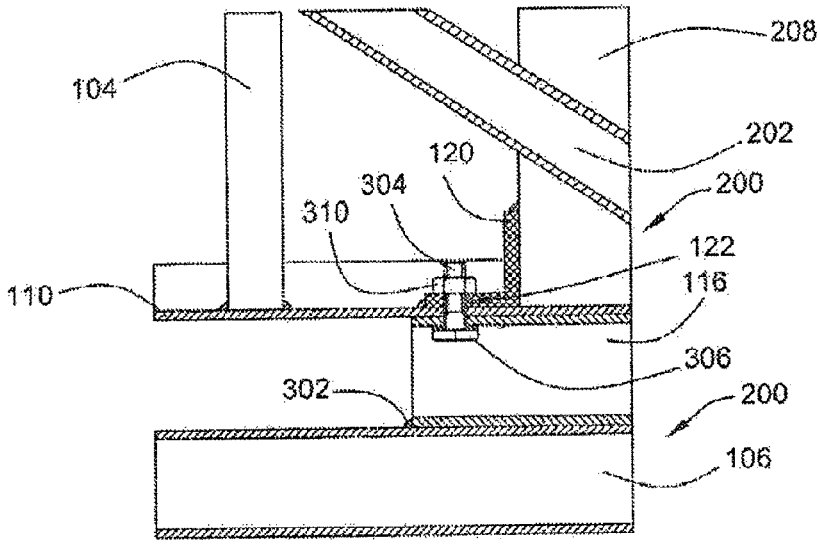
FIG. 5 is a cross section of a connection arrangement between two wall panels in accordance with the disclosure.

A partial outline of a connection block 116 is shown in FIG. 3, and of a bracket 120 is shown in FIG. 4. The cross section shown in FIG. 5 is meant to illustrate one embodiment for a connection arrangement between two vertically connected wall panels 100 or 200. More specifically, as shown in FIG. 3, the block 116 is welded atop the top rail 106 by use of, for example, two weld beads 302 extending along the outer edges of the block 116. A bolt 304 extends through the opening 118 such that a threaded section of the bolt 304 protrudes above the block 116. In the illustrated embodiment, a head 306 of the bolt 304 is connected, for example, by use of tack welding, onto the bottom surface of the top wall of the block 116. Weld beads or lines 308 connecting the top rail 106 to the two visible side rails 208 are shown extending along outer edges of the wall panel 200.

As shown in FIG. 4, the bracket 120 has an "L" shape and is connected at each inside corner between the vertical rails 208 and the top surface of the bottom rail 110. The hole or opening 122 is a through-hole meant to accommodate the threaded portion of the bolt 304. A partial cross section of the connection arrangement between two wall panels 200, which would be similar between two wall panels 100, is shown in FIG. 5. As can be seen from the illustration, the two stacked wall panels 200 are connected when the bolt 304 passes through the opening 122 and the two panels are secured to one another by a nut 310 engaged onto the bolt 304.

When wall panels 100 and/or 200 are stacked together, a stable support structure may be formed by welding vertically along corners of abutting panels as well as by providing temporary bracing between facing wall panels. One type of facing arrangement 600 is shown in the partial outline view of FIG. 6. The facing arrangement 600 includes crossing brace members 602 that extend in an "X" or "K" configuration across two opposite wall panels 100 or 200 in a four sided structure of wall panels, which is shown and discussed relative to FIG. 7. Each crossing brace member 602 includes round shaft portions 604 connected axially to one another through flat bar portions 604. Hooks 606 having a generally "J" shape are disposed at the ends of each brace member 602. The hooks 606 engage portions of the wall panels 100, for example, at the vertical supports 104. Pairs of brace members 602 disposed around a pin joint 608 are capable of interlocking the wall panels 100 or 200 such that vertical, shear, and lateral loading can be temporarily isostatically-supported until construction of the floor/ceiling portions is completed. In the illustrated embodiment, a portion of a floor/ceiling joist 610 is shown extending horizontally across the wall panels 100 or 200.

Figure 6:
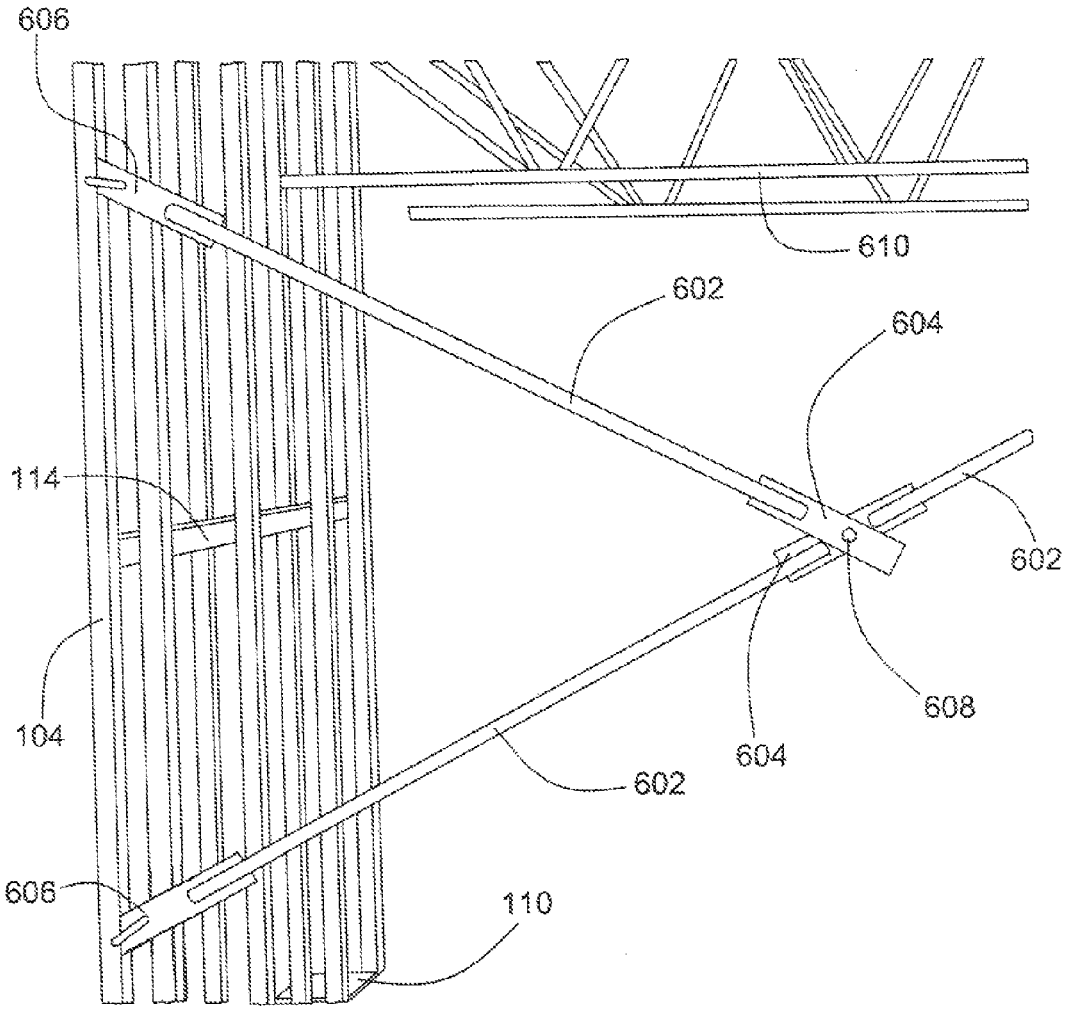
FIG. 6 is a partial outline view of a wall panel temporary support structure in accordance with the disclosure.
Figure 7:
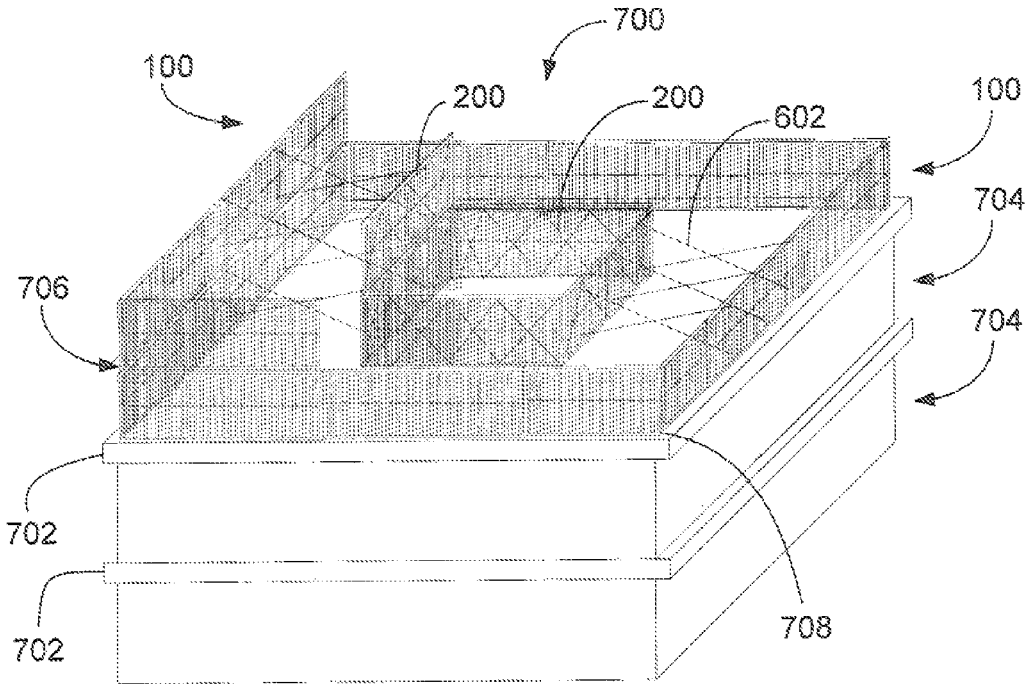
FIG. 7 is an outline view of wall panels partially assembled onto a building during construction in accordance with the disclosure.

An outline view of wall panels 100 and 200 partially assembled onto a building 700 during construction and in accordance with the disclosure is shown in FIG. 7. As shown, the building 700 may include completed floor slabs 702 at lower floors. A unitary wall panel 100 is mounted onto the topmost slab to form a support structure and ultimately a wall of the building. Each of four sides of the slab supports a wall panel 100. A second story or subsequent floor wall panel 100 is shown disposed on one side of the building 700 in accordance with the disclosure. The upper wall panel 100 is connected to the lower wall panel 100 by bolted connections 706 as shown in FIG. 6. At each of the corners 708 defined between adjacent walls, the wall panels 100 may be welded or bolted together to form a rectangular, continuous wall.

Wall panels 200 are shown disposed toward the center of the building 700 to form a core, within which elevators, stairwells, or other building portions may reside (none shown). Similar to the wall panels 100 forming non-core portions of the building 700, the wall panels 200 at the core portion of the building 700 may be welded at their corners and to each other. A plurality of cross braces 602 are shown disposed between facing walls of panels to provide structural rigidity to the panel assemblies until pouring of floors between the panels has been completed.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A modular, pre-assembled wall panel element configured as a load bearing structure for supporting vertical loading in a building, the wall panel element comprising:

a box frame having a generally rectangular shape, the box frame including:

a top rail having a generally elongate shape that extends along a length of the wall panel, a bottom rail, and two sets of side rail pairs interconnecting the top and bottom rails, wherein each set of side rails includes two side rail members extending parallel to one another and defining a gap therebetween, said gaps being aligned along the length of the wall panel and in communication to form a passageway through the wall panel, said passageway adapted for accommodating conduits or pipes extending through the wall panel when the wall panel is installed in the building, wherein each side rail pair is welded to the top rail and to the bottom rail to form an integral structure;

a plurality of vertical supports disposed parallel to one another and to the two side rails between the top and bottom rails, each vertical support including two vertical support members extending parallel to one another and defining an additional gap therebetween that is substantially aligned along the length of the wall panel and in communication with the gaps defined the side rail pairs; and an interconnection device adapted to interconnect each wall panel with an additional wall panel, wherein the interconnection device includes two blocks, each block being connected to the top rail and having a hole extending through said block, the two blocks disposed on top of two ends of the top rail, wherein each block has a height that spaces the wall panels apart to permit the pouring of a floor slab therebetween, wherein each hole extends through a top side wall of each block to accommodate a fastener therethrough for connecting the additional panel on top of the wall panel;

wherein the top rail is configured to distribute loading applied vertically from above the top rail substantially evenly along the length of the bottom rail, and wherein the wall panel is connectable to additional wall panels disposed at least one of vertically above the top rail, such that a bottom rail of an additional wall panel is connected to the top rail of the wall panel, and below the bottom rail, such that a top rail of a second additional wall panel is connected to the bottom rail of the wall panel, to form a wall of the building.

2. The wall panel of claim 1, wherein the top rail and the side rails are made of rectangular steel tube stock.

3. The wall panel of claim 1, wherein the bottom rail is made of cold-formed steel sheet having a U-section.

4. The wall panel of claim 1, wherein each of the two side rail members is disposed along an outer edge of the wall panel.

5. The wall panel of claim 1, further comprising a bridging rail extending horizontally along the length of the wall panel and disposed at about the midsection thereof.

6. The wall panel of claim 1, wherein each block is made of a section of rectangular tube stock.

7. The wall panel of claim 6, further comprising two angled brackets disposed, one each, at each end of the wall panel along an inner horizontal surface of the bottom rail, wherein the two angled brackets are configured to provide structural reinforcement around a hole formed in the bottom rail that is aligned with the hole in the corresponding block.

8. The wall panel of claim 1, further comprising two cross braces which extend in an "X" configuration between the four corners of the box frame.

9. A modular building system, comprising:

a plurality of modular, pre-assembled and inter-connectable wall panels configured to be assembled to one another for forming a load bearing structure for a building;

wherein each wall panel comprises a box frame having a generally rectangular shape, the box frame including:

a top rail having a generally elongate shape that extends along a length of the wall panel, a bottom rail, and two sets of side rail pairs interconnecting the top and bottom rails, wherein each set of side rails includes two side rail members extending parallel to one another and defining a gap therebetween, said gaps being aligned along the length of the wall panel and in communication to form a passageway through the wall panel, said passageway adapted for accommodating conduits or pipes extending through the wall panel when the wall panel is installed in the building;

a plurality of vertical supports disposed parallel to one another and to the two side rails between the top and bottom rails, each vertical support including two vertical support members extending parallel to one another and defining an additional gap therebetween that is substantially aligned along the length of the wall panel with the gaps defined the side rail pairs; and an interconnection device adapted to interconnect each wall panel with an additional wall panel, wherein the interconnection device includes two blocks, each block being connected to the top rail and having a hole extending through said block, the two blocks disposed on top of two ends of the top rail, wherein each block is made of a section of rectangular tube stock having a height that spaces the wall panels apart to permit the subsequent pouring of a floor slab therebetween, wherein each hole extends through a top side wall of each block to accommodate a fastener therethrough for connecting the additional panel on top of the wall panel;

wherein the top rail of each wall panel is configured to distribute loading applied vertically from above the top rail substantially evenly along the length of the bottom rail of each wall panel.

10. The building system of claim 9, wherein the top rail and the side rails are made of rectangular steel tube stock.

11. The building system of claim 9, wherein the bottom rail is made of cold-formed steel sheet having a U-section.

12. The building system of claim 9, wherein each of the two side rail members is disposed along an outer edge of the wall panel.

13. The building system of claim 9, wherein a gap is defined between each pair of side rails and vertical supports, and wherein the gap is configured to provide a passageway for conduits or pipes extending through the wall panel.

14. The building system of claim 9, further comprising a bridging rail extending horizontally along the length of the wall panel and disposed at about the midsection thereof.

15. The building system of claim 9, further comprising two angled brackets disposed, one each, at each end of the wall panel along an inner horizontal surface of the bottom rail, wherein the two angled brackets are configured to provide structural reinforcement around a hole formed in the bottom rail that is aligned with the hole in the corresponding block.

* * * * *